United States Patent [19]

Havel et al.

[11] 4,110,961

[45] Sep. 5, 1978

[54] SPINNING UNIT OF AN OPEN-END SPINNING MACHINE

[75] Inventors: Josef Havel, Usti nad Orlici; Václav Voborník, Letohrad; Josef Ripka, Usti nad Orlici; František Jaros, Usti nad Orlici; František Hortlik, Usti nad Orlici; Agaton Plananský, Usti nad Orlici; Božena Řehačková, Usti n/Orl., all of Czechoslovakia

[73] Assignee: Vyzkumny ustav bavlnarsky, Usti nad Orlici, Czechoslovakia

[21] Appl. No.: 841,603

[22] Filed: Oct. 12, 1977

[30] Foreign Application Priority Data

Oct. 19, 1976 [CS] Czechoslovakia ..... 6729-76

[51] Int. Cl.[2] ..... D01H 1/12

[52] U.S. Cl. ..... 57/58.89; 57/106

[58] Field of Search ..... 57/34 R, 58.89, 106, 57/58.91–58.95, 77.4

[56] References Cited

U.S. PATENT DOCUMENTS

| | | | |
|---|---|---|---|
| 3,543,500 | 6/1968 | Bancroft et al. | 57/58.89 |
| 3,640,061 | 2/1972 | Landwehrkamp | 57/58.89 |
| 3,789,597 | 2/1974 | Schon | 57/58.89 |
| 3,965,661 | 6/1976 | Yoshida | 57/58.89 |
| 3,986,332 | 10/1976 | Fukuda et al. | 57/58.89 |

FOREIGN PATENT DOCUMENTS

| | | | |
|---|---|---|---|
| 2,333,401 | 1/1975 | Fed. Rep. of Germany | 57/58.89 |
| 1,381,582 | 1/1975 | United Kingdom | 57/58.89 |

*Primary Examiner*—Donald Watkins

[57] ABSTRACT

A spinning unit of an open-end spinning machine comprising a spinning rotor to which separated fibers are supplied to be formed into a yarn which is withdrawn through a take-off duct and wound onto a bobbin. At its inlet end portion, the yarn take-off duct is rounded and embodied as an exchangeable funnel around which the yarn sweeps while it is given a false twist. In accordance with the invention the funnel and the body of the yarn take-off duct constitute a pair of members, the funnel being coupled with the body of said duct by magnetic coupling means so that funnels may readily be changed in accordance with the requirements of various fibrous materials to be processed by the spinning unit.

7 Claims, 4 Drawing Figures

SPINNING UNIT OF AN OPEN-END SPINNING MACHINE

Figure 1:
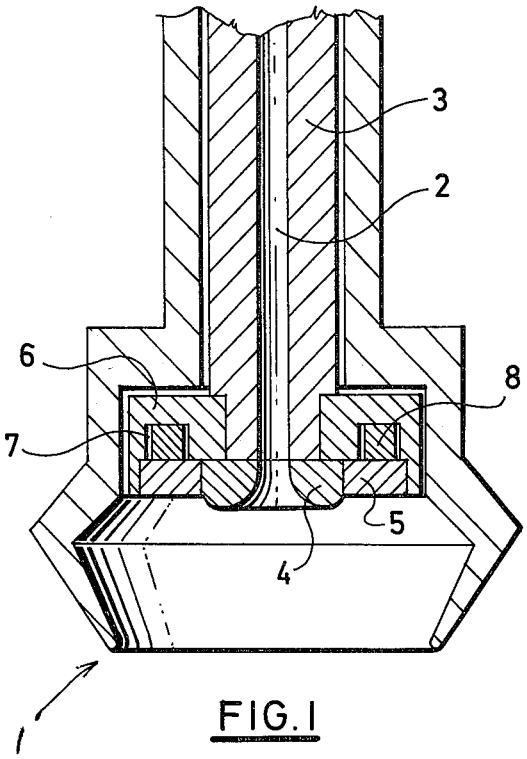

The present invention relates to a spinning unit of an open-end spinning machine comprising a mechanism for separating fibers from a sliver and a spinning rotor to which the separated fibers are supplied. Due to the rotation of the spinning rotor, yarn is built therein, withdrawn through a take-off duct and wound onto a bobbin.

The take-off duct constitutes a channel for the yarn to be taken off as well as for a trailing end to be reintroduced by being sucked back into the spinning rotor. At its inlet end portion, the yarn take-off duct is rounded and embodied as a funnel around which the yarn sweeps while deviating to about 90° from its original direction. Depending on the character of the fibrous material to be processed, the operative, yarn-contacting surface of the funnel may be roughened, knurled, provided with projections and depressions, or structured in any other manner in order to give the yarn a false twist, whereby the strength of the yarn increases in the span thereof between the collecting channel of the spinning rotor and the take-off mechanism, thereby decreasing the rate of breakage of the yarn.

Inasmuch as the variously structured operative surface of the funnel must be selected in accordance with the character of the fibrous material to be processed and the operative surface of the funnel is exposed to wear during operation, it is advisable to provide the yarn take-off duct with an exchangeable funnel, that is, as a part separate from the rotor proper. In a known embodiment, the funnel is screwed into the mouth of the duct, or is fastened therein by means of an elastic sleeve. However, the threaded joint is rather expensive to manufacture, and the changing of funnels is time-consuming. The essential disadvantage of such prior construction resides in the risk of the funnel becoming loose, owing to the vibrations of the spinning unit during operation. Needless to say, the prevention of the threaded joint from becoming loose involves complications, both in manufacturing the spinning unit and in operating it. When an elastic sleeve is employed to connect the funnel to the take-off duct, it is impossible to provide for a precise coaxial positioning of the funnel relative to the duct; this results in leaks between the contact surfaces of the two parts and the relatively rapid deterioration of the elastic sleeve due to the heat to which it is exposed.

In order to eliminate the disadvantages of the prior art as hereinbefore described, a spinning unit of an open-end spinning machine is provided in which the funnel and the body of the yarn take-off duct constitute a pair of separately formed members which are connected by magnetic coupling means. Such a magnetic connection of the exchangeable funnel with the body of the yarn take-off duct is simple to manufacture, inexpensive, and absolutely reliable in operation while assuring the coaxial positioning of the funnel opening relative to the take-off duct.

An essential advantage of the invention lies in the easy manner in which the funnel is exchanged. In a preferred embodiment, additional magnetic means are associated with the magnetic coupling means, the additional magnetic means having a reverse polarity relative to the magnetic coupling means and being designed to remove the funnel from the rotor. Preferably, the additional magnetic means has a higher magnetic field intensity than the magnetic coupling means.

In the most preferable embodiment, the magnetic coupling means incorporates, on the one hand, at least one permanent magnet fixedly attached to the funnel or to the body of the yarn take-off duct and, on the other hand, at least a part of the said duct facing said permanent magnet, said part being made of a ferromagnetic net material.

In an exemplary embodiment, the permanent magnet is located in the front wall of a head portion secured on the body of the yarn take-off duct, said body being embodied as a hollow spindle supporting the spinning rotor. The heat portion is provided, for example, with a recess for receiving the funnel made of a ferromagnetic material. In another embodiment, the ferromagnetic part of the funnel which is designed to engage the permanent magnet is a collar in which the funnel is secured.

In those designs in which the yarn take-off duct extends through a cover designed to mask the spinning rotor opening, the permanent magnet is made as a bushing secured in said cover.

Further, the permanent magnet may be embodied as a pressure ring for holding the funnel against the body of the yarn take-off duct, such body or at least the part thereof facing the pressure ring being made of ferromagnetic material.

Figure 3:
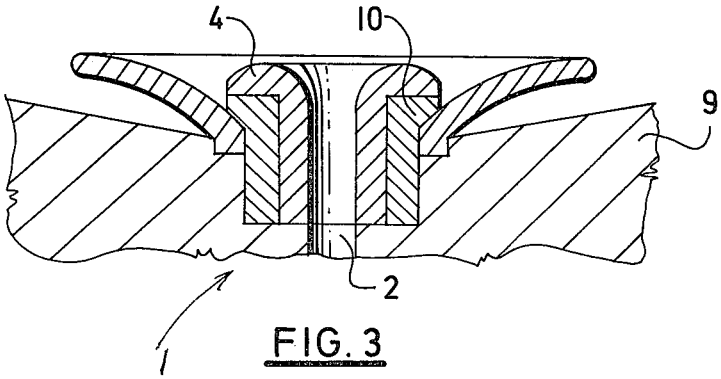
Figure 2:
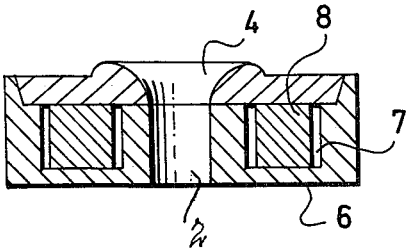
Figure 4:
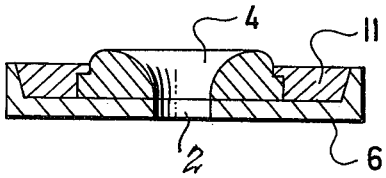

A number of embodiments of the spinning unit of the invention are illustrated in the accompanying drawing, in which:

FIG. 1 is a fragmentary view in axial section of a first embodiment of spinning unit in accordance with the invention; and FIGS. 2, 3, and 4 illustrate, respectively, three further embodiments of the means in accordance with the invention for coupling the exchangeable funnel with the body of the yarn take-off duct, all of FIGS. 2, 3, and 4 being axial sectional views.

Turning now to FIG. 1, there is there shown a spinning rotor 1 having a hollow spindle 3 with an axial bore 2 therethrough constituting a yarn take-off passage or duct. The spindle 3 supports the spinning rotor 1.

At the yarn inlet end of the take-off duct 2 there is arranged an exchangeable funnel 4, the operative surface of which is rounded. The funnel 4 is secured as by a press fit to a collar 5 made of ferromagnetic material. A recessed part of the spindle 3 has a head portion 6 secured thereto as by a press fit, the head portion 6 being made of ferromagnetic material and being provided with an annular recess 7 for receiving a circular permanent magnet 8. Magnet 8 is secured mechanically or by an adhesive to the head 6 so as to be disposed coaxially of the rotor and to provide air gaps between its inner and outer peripheral surfaces and the confronting walls of the recess in the head portion 6.

The collar 5 of the funnel 4 constitutes an armature for the magnet 8. The armature is attracted to the magnet 8 by forces generated by the magnetic flux which passes through the magnet 8, the head portion 6, and the collar 5. It will be apparent from the foregoing that the permanent magnet 8, which is provided in one member of the pair constituted by the exchangeable funnel 4 and the body 6 of the rotor, and the ferromagnetic part of the second member of said pair (i.e., collar 5 of the funnel 4) constitute a magnetic coupling means for connecting the funnel 4 to the body of the hollow spindle 3.

In the embodiment of the coupling means shown in FIG. 2, the annular magnet 8 is disposed in the recess 7 of the head 6 of the spindle in the same manner as in FIG. 1. In FIG. 2, however, the funnel 4 is itself made of a ferromagnetic material, and the collar 5, employed in FIG. 1, is, in effect, omitted.

In the embodiment of the connecting means shown in FIG. 3, the take-off duct or passage 2 extends through a cover 9 which masks the front opening of the spinning rotor 1. The permanent magnet here employed is embodied as a bushing 10 which is secured in the cover 9. The exchangeable funnel 4 is made wholly of ferromagnetic material.

In the embodiment shown in FIG. 4, the coupling means embodies a permanent magnet made in the form of a pressure ring 11 which secures the exchangeable funnel 4 in place, the head portion 6 being made of a ferromagnetic material.

When the funnel 4 in each of the embodiments of FIGS. 1, 2, and 3, is to be exchanged, it is removed, for example, by applying an additional magnetic means (not shown) having a polarity which is the reverse of magnet 8 and preferably having a higher flux intensity than that of magnet 8, to the magnetic coupling whereby to overcome the effect of magnet 8 and to facilitate the removal of the funnel. When the funnel of the embodiment shown in FIG. 4 is to be removed, the pressure plate 11 is exposed to the reverse pole of the additional magnetic means, whereby the pressure ring 11 is attracted through the additional magnetic means and the funnel is released.

Although the invention is illustrated and described with reference to a preferred plurality of embodiments thereof, it is to be expressly understood that it is in no way limited to the disclosure of such a preferred plurality of embodiments, but is capable of numerous modifications within the scope of the appended claims.

What is claimed is:

1. An open-end spinning unit comprising a spinning rotor having a body with a take-off duct therein, fibers being introduced into the inlet end of the take-off duct and yarn being withdrawn from the outlet end of the take-off duct, an exchangeable funnel at the inlet end of the take-off duct, and detachable magnetic means coupling the funnel with the body of the rotor.

2. A spinning unit as claimed in claim 1, wherein the magnetic coupling means comprises at least one permanent manget fixedly attached to a first one of the funnel and the body of the rotor, the second one of the funnel and the body of the rotor being made of a ferromagnetic material.

3. A spinning unit as claimed in claim 2, comprising a head portion secured on the rotor at the entrance end of the yarn take-off duct, and wherein the permanent magnet is located in the front wall of said head portion, the body of the rotor being a hollow spindle supporting the rotor.

4. A spinning unit as claimed in claim 3, wherein the head portion is provided with a recess to receive the funnel, at least a part of the funnel being made of a ferromagnetic material.

5. A spinning unit as claimed in claim 4, wherein the ferromagnetic part of the funnel which interacts with the permanent magnet is a collar to which the funnel is secured.

6. A spinning unit as claimed in claim 2, wherein the permanent magnet is a bushing for the funnel, the funnel being made of ferromagnetic material, and a cover masking the spinning rotor opening and constituting the body of the rotor, said bushing being secured in the cover.

7. A spinning unit as claimed in claim 1, wherein the magnetic coupling means comprises a permanent magnet formed as a pressure ring for holding the funnel against the body of the rotor, at least a part of said body facing the pressure ring being made of ferromagnetic material and constituting a part of the magnetic coupling means.

* * * * *